US007876047B2

(12) United States Patent
Song et al.

(10) Patent No.: US 7,876,047 B2
(45) Date of Patent: Jan. 25, 2011

(54) PLASMA DISPLAY PANEL HAVING ELECTRODES COVERED BY A DIELECTRIC LAYER HAVING VARYING PERMITTIVITES

(75) Inventors: Jung-Suk Song, Yongin-si (KR); Ki-Dong Kim, Yongin-si (KR); Seong-Hun Choo, Yongin-si (KR); Joon-Hyeong Kim, Yongin-si (KR); Sang-Hyun Kim, Yongin-si (KR); Bo-Won Lee, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 973 days.

(21) Appl. No.: 11/727,475

(22) Filed: Mar. 27, 2007

(65) Prior Publication Data

US 2007/0228966 A1 Oct. 4, 2007

(30) Foreign Application Priority Data

Mar. 29, 2006 (KR) ..... 10-2006-0028288

(51) Int. Cl.
*H01J 17/49* (2006.01)

(52) U.S. Cl. ..... 313/586; 313/587

(58) Field of Classification Search ..... 313/582–587; 345/60; 445/23–25

See application file for complete search history.

(56) References Cited

U.S. PATENT DOCUMENTS

| | | | |
|---|---|---|---|
| 6,788,004 | B1 | 9/2004 | Aoki et al. |
| 7,071,621 | B1 | 7/2006 | Namiki et al. |
| 2005/0280369 | A1 | 12/2005 | Hashikawa |

FOREIGN PATENT DOCUMENTS

| | | | |
|---|---|---|---|
| CN | 1 345 457 | A | 4/2002 |
| JP | 2000-306515 | A | 11/2000 |
| KR | 10-2002-0062003 | A | 7/2002 |
| KR | 10-2005-0029073 | A | 3/2005 |

*Primary Examiner*—Joseph L Williams
(74) *Attorney, Agent, or Firm*—Lee & Morse, P.C.

(57) ABSTRACT

A plasma display panel having a uniformly distributed firing voltage despite of irregular discharge gaps, the plasma display panel including a first substrate, a second substrate facing the first substrate, barrier ribs between the first and second substrates to define discharge cells, address electrodes corresponding to the discharge cells and extending in a first direction, first and second electrodes respectively extending in a second direction crossing the first direction and formed on any one of the first and second substrates, corresponding to the discharge cells, and a dielectric layer covering the first and second electrodes, where the first and second electrodes are spaced apart from each other to form a discharge gap having distances, the dielectric layer having varied permittivities according to distances of the discharge gaps to improve discharge uniformity according to the distances of the discharge gaps.

13 Claims, 7 Drawing Sheets

PLASMA DISPLAY PANEL HAVING ELECTRODES COVERED BY A DIELECTRIC LAYER HAVING VARYING PERMITTIVITES

BACKGROUND OF THE INVENTION

1. Field of the Invention

The present invention relates to a plasma display panel. More particularly, the present invention relates to a plasma display panel that may improve discharge uniformity by varying a permittivity of a dielectric layer according to a size of a discharge gap.

2. Description of the Related Art

A plasma display panel may generally use vacuum ultraviolet (VUV) rays emitted from plasma generated by gas discharge so as to excite a phosphor material. The excited phosphor material may generate red (R), green (G), and blue (B) visible light beams, so that an image may be displayed.

In an AC type plasma display panel, address electrodes may be formed on a rear substrate. The address electrodes may be covered with a dielectric layer. Barrier ribs may respectively be arranged in a stripe pattern between the address electrodes on the dielectric layer. R, G, and B phosphor layers may be in the barrier ribs. A front substrate may face the rear substrate. Display electrodes constructed with pairs of sustain electrodes and scan electrodes may be on the front substrate in a direction crossing the address electrodes. The display electrodes may be covered with a dielectric layer and an MgO protective layer. Discharge cells may be at a portion where the address electrodes on the rear substrate cross the display electrodes on the front substrate. Millions or more of unit discharge cells may be arranged in the plasma display panel in a matrix pattern.

Memory characteristics may be used to drive the discharge cells of the plasma display panel. Specifically, in order for a discharge to occur between the sustain electrodes and the scan electrodes constituting the display electrodes, an electric potential difference over a predetermined voltage may be required. A threshold voltage thereof may be a firing voltage Vf. When a scan voltage and an address voltage are respectively supplied to the scan electrodes and the address electrodes, a discharge may initially occur to produce plasma in the discharge cells. Electrons and ions of the plasma may be transferred towards an electrode having an opposite polarity.

Each electrode of the plasma display panel may be coated with a dielectric layer. Most of transferred space charges may be accumulated on the dielectric layer having an opposite polarity. Therefore, a net space voltage between the scan electrodes and the address electrodes may become lower than an initially provided address voltage Va. As a result, a discharge may diminish, and an address discharge may disappear. In this case, the amount of electrons accumulated in the sustain electrodes may be relatively small, while the amount of ions accumulated in the scan electrodes may be relatively large. Charges accumulated on the dielectric layer covering the sustain electrodes and the scan electrodes may be wall charges Qw. A space voltage produced between the sustain electrodes and the scan electrodes by the wall charges Qw may be a wall voltage Vw.

When a discharge sustain voltage Vs is supplied to the sustain electrodes and the scan electrodes, if a sum voltage Vs+Vw of the discharge sustain voltage Vs and the wall voltage Vw is greater than the firing voltage Vf, a sustain discharge may occur in the discharge cells. As a result, a VUV ray may be generated to excite a corresponding phosphor layer. Accordingly, a visible light beam may be emitted through the transparent front substrate.

When the address discharge does not occur between the scan electrodes and the address electrodes (that is, when the address voltage Va is not provided), the wall charges Qw may not accumulate between the sustain electrodes and the scan electrodes. As a result, the wall voltage Vw may not exist between the sustain electrodes and the scan electrodes. In this case, only the discharge sustain voltage Vs supplied to the sustain electrodes and the scan electrodes may be produced in the discharge cells. Since the discharge sustain voltage Vs may be lower than the firing voltage Vf, a discharge may not occur in a gas space between the sustain electrodes and the scan electrodes.

In the plasma display panel driven in the aforementioned manner, a discharge gap may be formed between a transparent electrode of the sustain electrode and a transparent electrode of the scan electrode.

Referring to FIG. 9, discharge cells LC each having a relatively long gap may have a high firing voltage, and discharge cells SC each having a short gap may have a low firing voltage. Discharge cells MC each having a medium firing voltage may have a firing voltage between the high firing voltage and the low firing voltage.

The transparent electrodes may be formed by using various methods, e.g., an etching method. However, it may be difficult to form the transparent electrodes to have uniform sizes due to manufacturing errors. In this case, the transparent electrodes of the plasma display panel may have irregular sizes, and thus a discharge gap also may become irregular. As a result, there may be problems arising from a firing voltage becomes irregular.

The above information disclosed in this Background section is only for enhancement of understanding of the background of the invention and therefore it may contain information that does not form the prior art that is already known in this country to a person of ordinary skill in the art.

SUMMARY OF THE INVENTION

It is therefore a feature of an embodiment of the present invention to provide a plasma display apparatus having electrodes covered by a dielectric layer which substantially overcomes one or more of the problems due to the limitations and disadvantages of the related art.

At least one of the above and other features and advantages of the present invention may be realized by providing a plasma display panel, which may include a first substrate, a second substrate facing the first substrate, barrier ribs between the first and second substrates, the barrier ribs defining discharge cells, address electrodes corresponding to the discharge cells, the address electrode extending in a first direction, first and second electrodes which extend in a second direction crossing the first direction, the first electrodes and second electrodes being on any one of the first substrate or the second substrate corresponding to the discharge cells, the first electrodes and the second electrodes being spaced apart from each other to form discharge gaps having distances, and a dielectric layer covering the first and second electrodes, where the dielectric layer may have varying permittivities depending on the respective distances of the discharge gaps.

The discharge gap may have at least two different distances. The dielectric layer may have at least two permittivities. The discharge gap may include a first discharge gap having a first distance, and a second discharge gap having a second distance that is less than the first distance, where the permittivity of the dielectric layer corresponding to the first discharge gap may be higher than the permittivity of the dielectric layer corresponding to the second discharge gap.

The first and second electrodes may include bus electrodes extending in the second direction at both edges of the discharge cells, and transparent electrodes protruding towards respective centers of the discharge cells in the first direction, where the discharge gaps may be formed between the transparent electrodes of the first electrodes and the transparent electrodes of the second electrodes.

The first substrate or the second substrate may be in a shape of a rectangle, and the distances of the discharge gaps and the permittivities of the dielectric layer may become larger from one long side of the rectangle to the other long side of the rectangle. The first substrate or the second substrate may be formed in a shape of a rectangle, and the distances of the discharge gaps and the permittivities of the dielectric layer may become larger from one short side of the rectangle to the other short side of the rectangle. The dielectric layer may be constructed with a sheet having at least two permittivities. The discharge gaps may include a first discharge gap having a first distance, and a second discharge gap having a second distance that is less than the first distance, where a thickness of the dielectric layer corresponding to the first discharge gap may be greater than a thickness of the dielectric layer corresponding to the second discharge gap. The discharge gaps may include a first discharge gap having a first distance, and a second discharge gap having a second distance that is less than the first distance, where the dielectric layer may be covered with a protective layer, and a partial pressure of the protective layer corresponding to the first discharge gap may be lower than a partial pressure of the protective layer corresponding to the second discharge gap.

At least one of the above and other features and advantages of the present invention may be realized by providing a method of manufacturing a plasma display panel, which may include facing a first substrate and a second substrate, forming barrier ribs between the first substrate and the second substrate, the barrier ribs defining discharge cells, extending address electrodes in a first direction to correspond to the discharge cells, extending first electrodes and second electrodes in a second direction crossing the first direction, the first electrodes and second electrodes being on any one of the first substrate and the second substrate corresponding to the discharge cells, the first electrodes and the second electrodes being spaced apart from each other to form discharge gaps having distances, and covering the first electrodes and the second electrodes with a dielectric layer, where the dielectric layer may have varying permittivities depending on respective distances of the discharge gaps.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
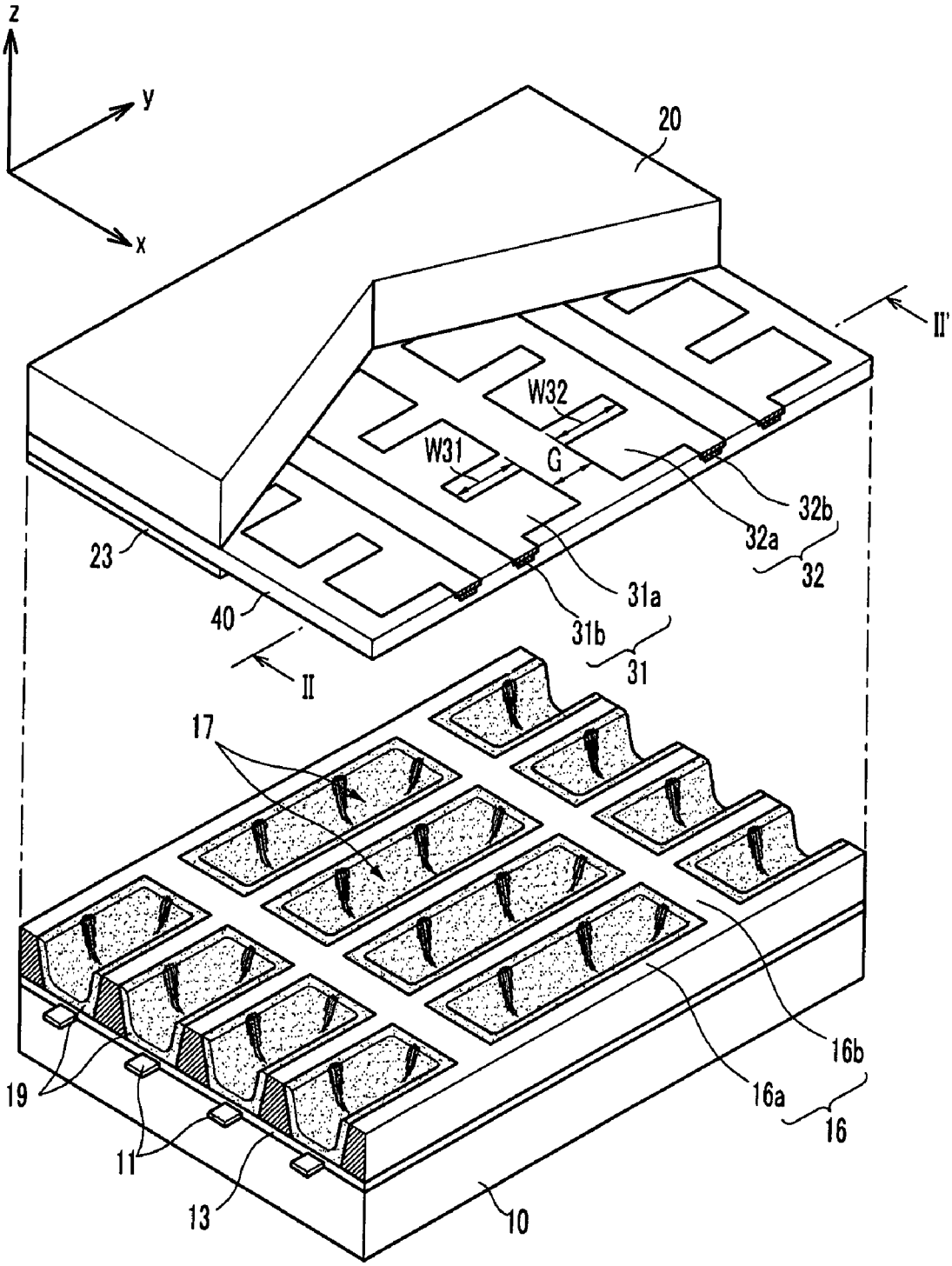
FIG. 1 illustrates a schematic exploded view of a plasma display panel according to an embodiment of the present invention.

Korean Patent Application No. 10-2006-0028288, filed on Mar. 29, 2006, in the Korean Intellectual Property Office, and entitled: "Plasma Display Panel," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
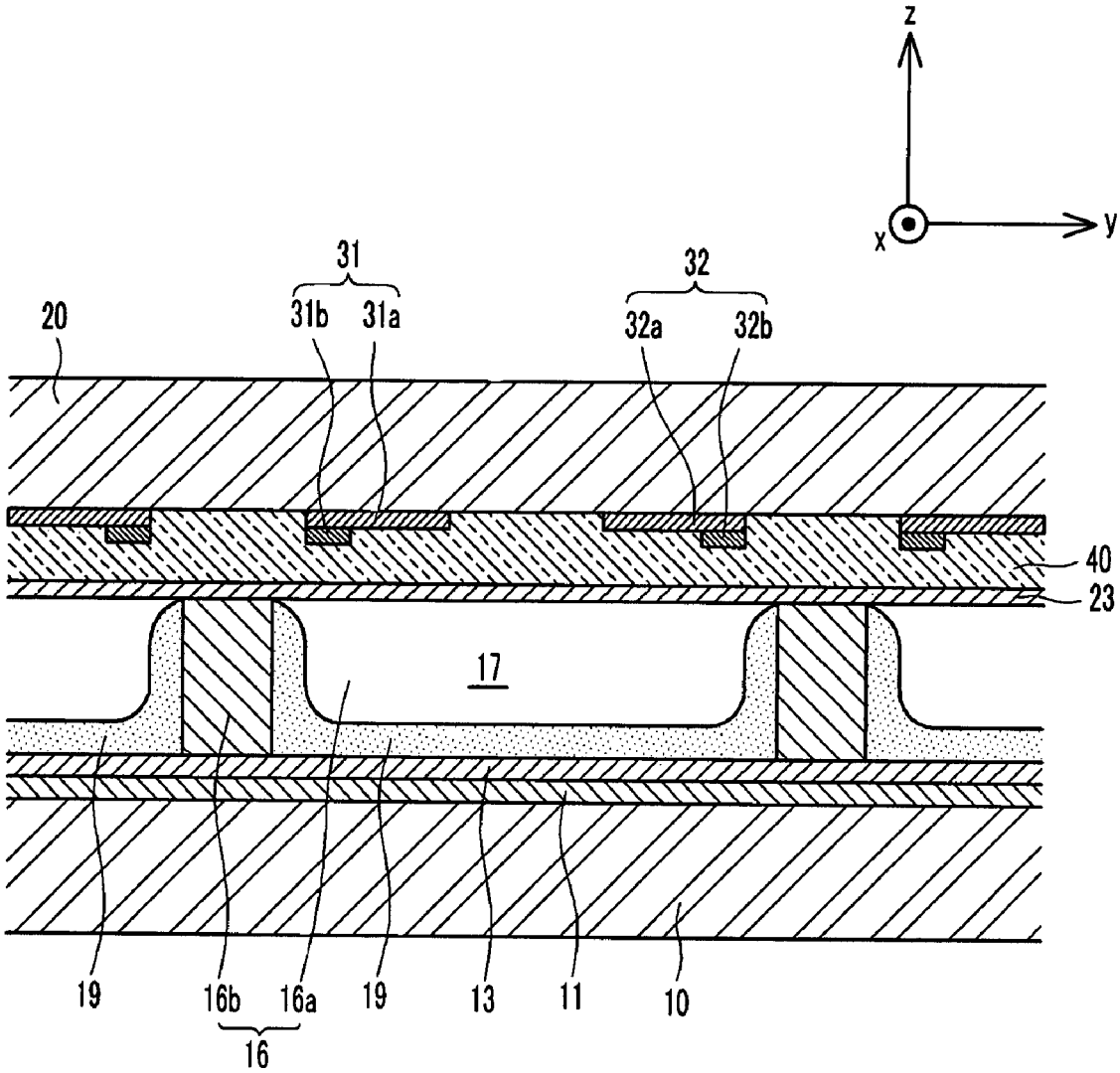
FIG. 2 illustrates a cross-sectional view taken along line II-II' of FIG. 1.

FIG. 1 illustrates a schematic exploded view of a plasma display panel according to an embodiment of the present invention. FIG. 2 illustrates a cross-sectional view taken along line II-II' of FIG. 1.

Referring to FIGS. 1 and 2, the plasma display panel may include a first substrate 10 (hereinafter, referred to as a rear substrate) and a second substrate 20 (hereinafter, referred to as a front substrate) which face each other at a predetermined distance and may be sealed together. Multiple barrier ribs 16 may be between the substrates 10 and 20.

The barrier ribs 16 may be between the rear substrate 10 and the front substrate 20 to define multiple discharge cells 17. The discharge cells 17 may be filled with a discharge gas, e.g., a gas mixture containing neon (Ne) and xenon (Xe), so that vacuum ultraviolet (VUV) rays may be generated via a gas discharge. Each discharge cell 17 may include a phosphor layer 19 which absorbs the VUV rays to emit a visible light beam.

In order to form an image by the gas discharge, the plasma display panel may include address electrodes 11 disposed between the rear substrate 10 and the front substrate 20 and corresponding to the respective discharge cells 17. The plasma display panel may also include first electrodes 31 (hereinafter, referred to sustain electrodes) and second electrodes 32 (hereinafter, referred to scan electrodes).

The address electrodes 11 may be on the upper surface of the rear substrate 10 and may extend in a first direction (the y-axis direction of the figure) to sequentially correspond to the adjacent discharge cells 17. The address electrodes 11 may be parallel with each other and correspond to the adjacent discharge cells 17 in a second direction (the x-axis direction in the figure) crossing the first direction.

The address electrodes 11 may be covered with a dielectric layer 13 that may cover the upper surface of the rear substrate 10. The dielectric layer 13 may prevent the address electrodes 11 from being directly bombarded with positive ions or electrons during a discharge, thereby protecting the address electrodes 11 against damage. Further, the dielectric layer 13 may form and accumulate wall charges. The address electrodes 11 on the rear substrate 10 may not interfere when the visible beam is transmitted forward. Thus, the address electrodes 11 may be made of an opaque material, e.g., a metallic material having an excellent conductivity.

The barrier ribs 16 may be on the dielectric layer 13 of the rear substrate 10 so as to define the discharge cells 17. The barrier ribs 16 may include first barrier members 16*a* extending in the first direction and second barrier members 16*b* extending in the second direction, so as to form the discharge cells 17 in a matrix pattern.

If the barrier ribs 16 include only the first barrier members 16*a* extending in the first direction so as to be parallel to the second direction, the discharge cells 17 may be formed in a stripe pattern.

The phosphor layers 19 may be respectively formed in the discharge cells 17. In order to form the phosphor layers 19, a photoconductive phosphorous paste may be coated on lateral surfaces of the barrier ribs 16 and the surface of the dielectric layer 13. The photoconductive phosphorous paste may then undergo drying, light exposure, development, and annealing processes.

For the discharge cells 17 arranged in the first direction, the phosphor layers 19 may have the same color. On the other hand, for the discharge cells 17 repeatedly arranged in the second direction, red (R), green (G), and blue (B) phosphor layers 19 may be repeatedly formed.

The sustain electrodes 31 and the scan electrodes 32 may be on the lower surface of the front substrate 20 and may correspond to the respective discharge cells 17, thereby forming a surface discharge structure. The sustain electrodes 31 and the scan electrodes 32 may extend in the second direction crossing the first direction.

The sustain electrodes 31 and the scan electrodes 32 may cross the address electrodes 11, may face each other to correspond to the discharge cells 17, and may be covered with a dielectric layer 40. The dielectric layer 40 may protect the sustain electrodes 31 and the scan electrodes 32 against a gas discharge. Further, the dielectric layer 40 may form and accumulate wall charges during the discharge.

The dielectric layer 40 may be covered with a protective layer 23. The protective layer 23 may be made of a transparent material, e.g., MgO, which may protect the dielectric layer 40, thereby increasing a secondary electron emission coefficient during a discharge.

The sustain electrodes 31 and the scan electrodes 32 respectively may include transparent electrodes 31*a* and 32*a* generating a discharge, and bus electrodes 31*b* and 32*b* respectively supplying a voltage signal to the transparent electrodes 31*a* and 32*a*.

The transparent electrodes 31*a* and 32*a* may produce a surface discharge inside the discharge cells 17. In order to ensure good aperture ratios for the discharge cells 17, the transparent electrodes 31*a* and 32*a* may be made of a transparent material, e.g., indium tin oxide (ITO), indium zinc oxide (IZO), etc. The bus electrodes 31*b* and 32*b* may be made of a metal material having excellent conductivity so that high electric resistances of the transparent electrodes 31*a* and 32*a* may be compensated.

Figure 3:
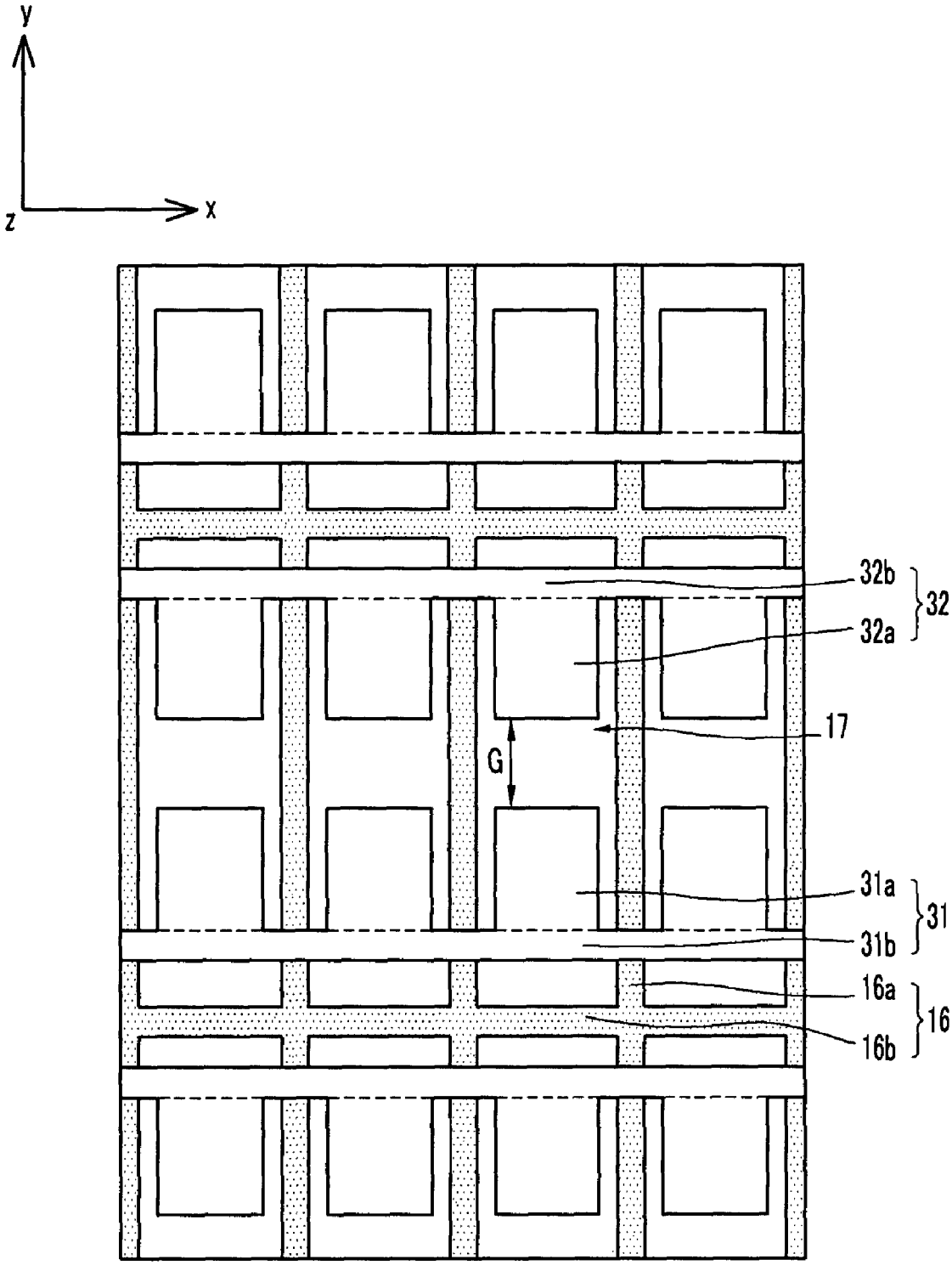
FIG. 3 illustrates a plan view of a layout relation between barrier ribs and electrodes.

Referring to FIG. 3, the transparent electrodes 31*a* and 32*a* may protrude from edge portions of the discharge cells 17 towards center portions thereof in the first direction. A discharge gap G may be at a center portion of each discharge cell 17. As illustrated in FIG. 1, the discharge gap G may have extended gap portions W31 and W32 that respectively extend into the transparent electrodes 31*a* and 32*a*.

The bus electrodes 31*b* and 32*b* may be respectively arranged on the transparent electrodes 31*a* and 32*a* and extend in the second direction from the edge portions of the discharge cells 17. When voltage signals are supplied to the bus electrodes 31*b* and 32*b*, the voltage signals may be respectively supplied to the transparent electrodes 31*a* and 32*a* connected to the bus electrodes 31*b* and 32*b*, respectively.

When the plasma display panel is driven, a reset discharge may occur during a rest period in response to a reset pulse supplied to the sustain electrodes 31. An address discharge may occur during an address period in response to a scan pulse supplied to the scan electrodes 32 and an address pulse supplied to the address electrodes 11. A sustain discharge may occur during a sustain period in response to a sustain pulse supplied to the sustain electrodes 31 and the scan electrodes 32.

The sustain electrodes 31 and the scan electrodes 32 may function as electrodes for providing the sustain pulse required for the sustain discharge. The scan electrodes 32 may function as electrodes for providing the reset pulse and the scan pulse. The address electrodes 11 may function as electrodes for providing the address pulse. The sustain electrodes 31, the scan electrodes 32, and the address electrodes 11 may function in a different manner according to a voltage waveform supplied to each electrode. Thus, these electrodes are not limited to the aforementioned functions.

In the plasma display panel, the discharge cells 17 to be turned on may be selected when the address discharge occurs due to an interaction between the address electrodes 11 and the scan electrodes 32. Further, the discharge cells 17 may be driven from those selected when the sustain discharge occurs due to an interaction between the sustain electrodes 31 and the scan electrodes 32. As a result, an image may be formed.

The permittivity of the dielectric layer 40 covering the sustain electrodes 31 and the scan electrodes 32 may vary depending on a size, i.e., distance, of the discharge gap G. For example, for a discharge gap G having a size of about 70 μm, about 75 μm, about 80 μm, and about 85 μm, the permittivity of the dielectric layer 40 may be about 12.3, about 12.8, about 13.3, and about 13.6, respectively. If the relationship is considered to be linear, multiplying the discharge gap by about 0.168 will yield the approximate permittivity.

Widening the distance of the discharge gap G may increase a firing voltage Vf. Narrowing the distance of the discharge gap G may lower the firing voltage Vf. Furthermore, lowering the permittivity of the dielectric layer 40 may raise the firing voltage Vf. Raising the permittivity of the dielectric layer 40 may lower the firing voltage Vf.

In the present invention, since the permittivity of the dielectric layer 40 may increase as the distance of the discharge gap G is widened, the raising of the firing voltage Vf caused by the increase of the distance of the discharge gap G, and the falling of the firing voltage Vf caused by the increase of the permittivity of the dielectric layer 40, may compensate each other.

Also, since the permittivity of the dielectric layer 40 may decrease as the distance of the discharge gap G is narrowed, the falling of the firing voltage Vf caused by the reduction of the discharge G and the raising of the firing voltage Vf caused by the reduction of the permittivity of the dielectric layer 40 may compensate each other.

According to the present invention, since the permittivity of the dielectric layer 40 may change along with the change of the discharge gap G, the firing voltage Vf may be uniformly maintained. As a result, the plasma display panel may have improved discharge uniformity.

The magnitude of the firing voltage Vf may be related to the thickness of the dielectric layer 40. When the thickness of the dielectric layer 40 is increased by about 1 μm, the firing voltage Vf may be increased by about 3V. Therefore, the firing voltage Vf may be uniformly maintained by controlling not only the permittivity of the dielectric layer 40, but also the thickness of the dielectric layer 40. That is, the firing voltage Vf may be high when the discharge gap G is wide. In this case, the firing voltage Vf may be decreased by reducing the thickness of the dielectric layer 40. As a result, the firing voltage Vf may be uniformly maintained. Of course, the same may be applied when the discharge gap G is narrow.

Increasing the partial pressure of the protective layer 23 covering the dielectric layer 40 may raise the firing voltage Vf. When the partial pressure is about $1.26\times10^{-7}$ Torr, the firing voltage Vf may be about 248V. However, when the partial pressure is about $7.73\times10^{-7}$ Torr, the firing voltage Vf may be about 256V, i.e., increased by about 8V. Moreover, if a grain size of the protective layer 23 is large, its partial pressure may be increased. Therefore, increasing the grain size may raise the firing voltage Vf. Accordingly, when the discharge gap G is wide, the firing voltage Vf may be high, and the firing voltage Vf may be uniformly maintained by using the protective layer 23 having a low partial pressure. On the contrary, when the discharge gap G is narrow, the same may be achieved in an opposite manner.

The discharge gaps G may be formed between the transparent electrodes 31*a* of the sustain electrodes 31 and the transparent electrodes 32*a* of the scan electrodes 32.

The transparent electrodes 31*a* and 32*a* may be formed in the respective discharge cells 17 to have two different sizes instead of having the same size. The transparent electrodes 31*a* and 32*a* may have different sizes for the respective discharge cells 17. Likewise, the permittivity of the dielectric layer 40 may be different in each discharge cell 17.

As described above, according to the present invention, in order to uniformly maintain the firing voltage Vf, the permittivity of the dielectric layer 40 may vary depending on the size of the discharge gap G.

Figure 4:
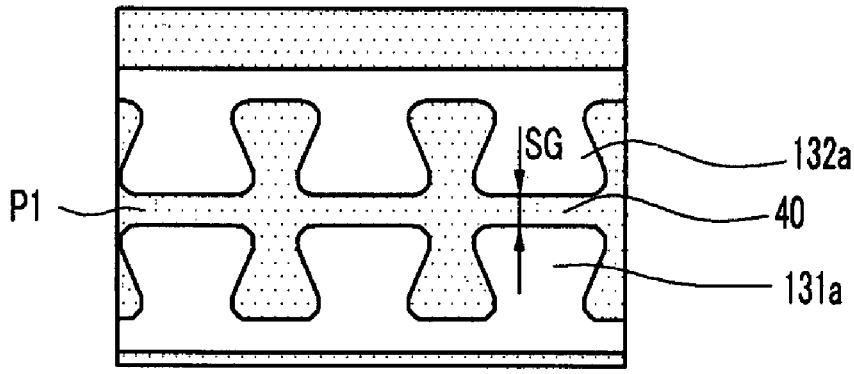
FIG. 4 illustrates a partially enlarged view of a transparent electrode forming a short gap.

Referring to FIG. 4, a short gap SG may be formed between transparent electrodes 131*a* and 132*a*. To cope with the short gap SG, the dielectric layer 40 may have a low permittivity P1.

The transparent electrodes 131*a* and 132*a* forming the short gap SG may generate a sustain discharge at a low firing voltage Vf. The dielectric layer 40 having the low permittivity P1 may slightly reduce the firing voltage Vf.

Figure 5:
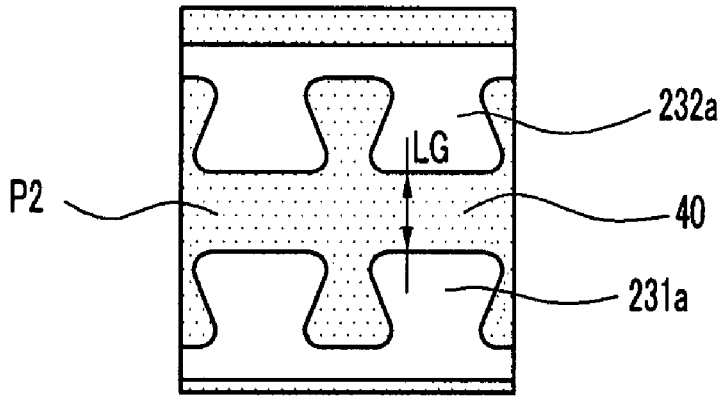
FIG. 5 illustrates a partially enlarged view of a transparent electrode forming a long gap.

Referring to FIG. 5, a long gap LG may be formed between transparent electrodes 231*a* and 232*a*. To cope with the long gap LG, the dielectric layer 40 may have a high permittivity P2.

The transparent electrodes 231*a* and 232*a* forming the long gap LG may generate a sustain discharge at a high firing voltage Vf. Therefore, the dielectric layer 40 having high permittivity P2 may significantly reduce the firing voltage Vf.

Herein, the short gap SG, the long gap LG, the low permittivity P1, and the high permittivity P2 may be all relative values.

Figure 6:
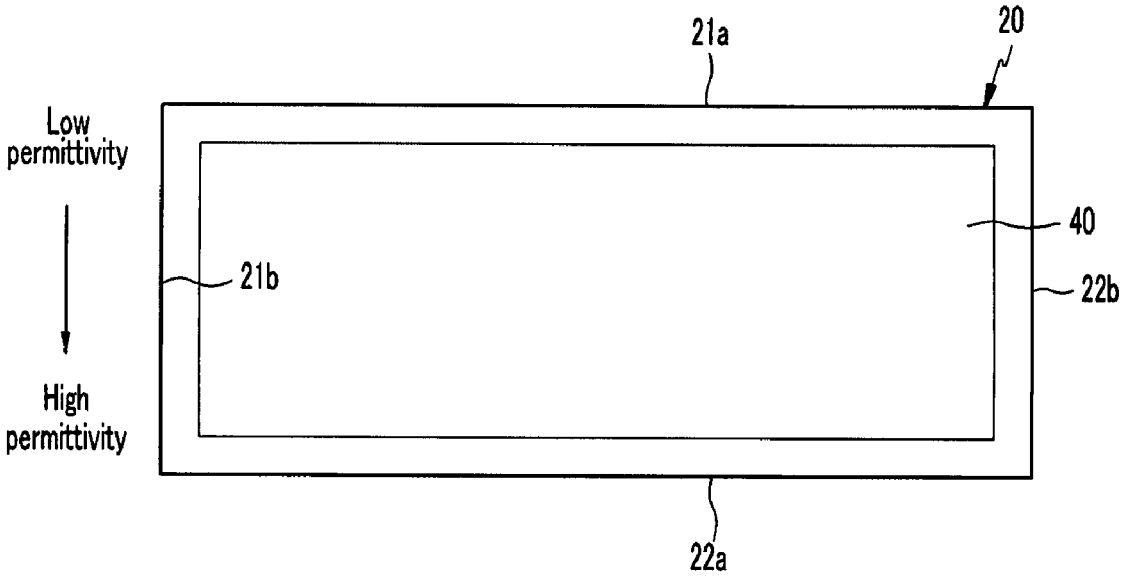
FIG. 6 illustrates a plan view of a dielectric sheet according to a first embodiment of the present invention.

Referring to FIG. 6, the dielectric layer 40 may be attached on the front substrate 20 having first and second long sides 21*a* and 22*a* parallel to each other and short sides 21*b* and 22*b* perpendicular to the first and second long sides 21*a* and 22*a*. The dielectric layer 40 may be constructed to include a rectangular sheet covering the sustain electrodes 31 and the scan electrodes 32.

Besides the rectangular sheet, the dielectric layer 40 may be constructed using a paste or other equivalents. In the present invention, an integral type sheet may be attached by using, e.g., a tape, etc.

The dielectric layer 40 may have a permittivity distribution in which the permittivity becomes higher from the first long side 21*a* to the second long side 22*a*. In this case, the discharge gap G has a pattern in which the discharge gap G may become wider from the first long side 21*a* where the short gap SG is formed to the second long side 22*a* where the long gap LG is formed.

Figure 7:
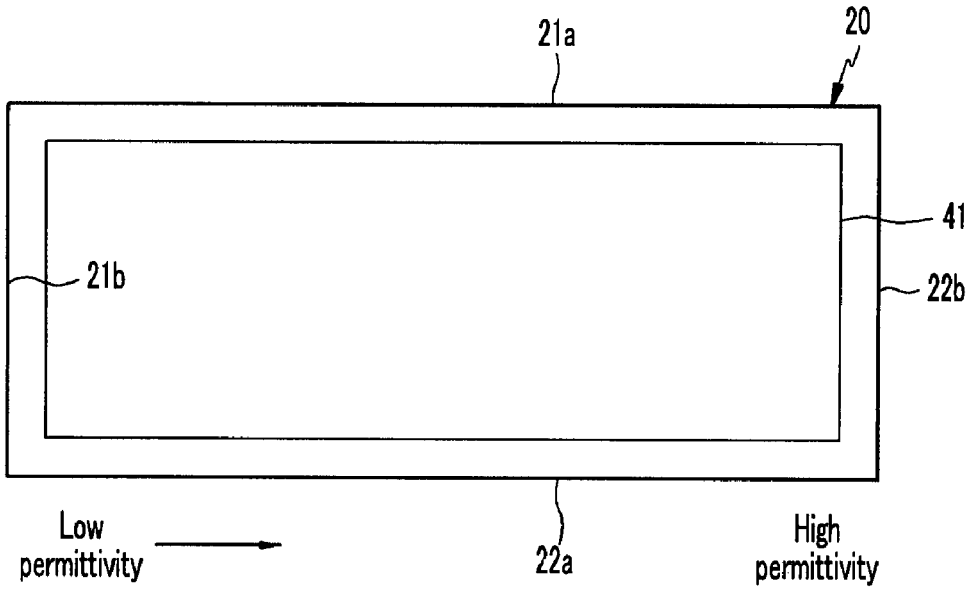
FIG. 7 illustrates a plan view of a dielectric sheet according to a second embodiment of the present invention.

Referring to FIG. 7, a dielectric layer 41 may have a permittivity distribution in which its permittivity becomes higher from the first short side 21*b* to the second short side 22*b*. In this case, the discharge gap G may have a pattern in which the discharge gap G becomes wider from the first short side 21*b*, where the short gap SG is formed, to the second short side 22*b* where the long gap LG is formed. Also, it may be possible to have a dielectric layer which combines the permittivity gradients illustrated in FIGS. 6 and 7 such that the lowest permittivity may be at one corner and the highest permittivity may be at the opposite diagonal corner.

Figure 8:
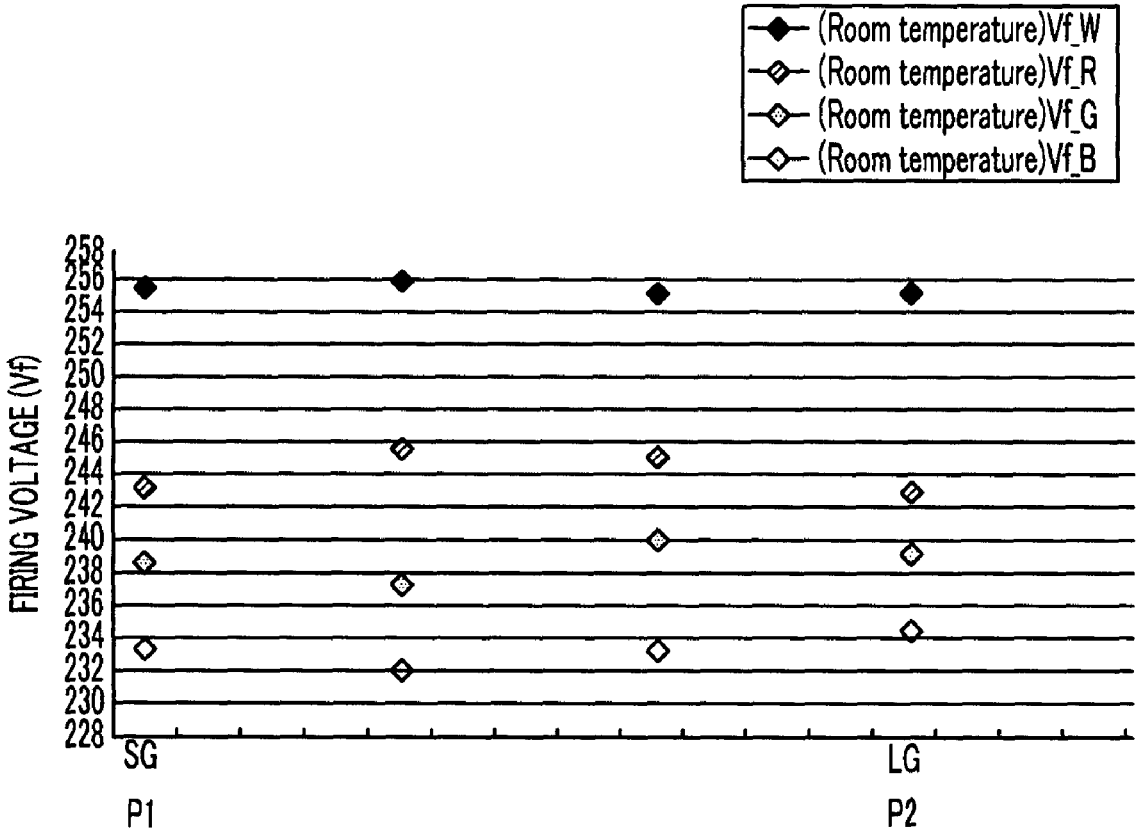
FIG. 8 illustrates a distribution of a firing voltage with respect to a discharge gap.

Referring to FIG. 8, for each color of the phosphor layer 19, a discharge gap may be formed to be the short gap SG. The discharge gap may be formed to be the long gap LG when the discharge cells 17 correspond to the dielectric layer 40 having the low permittivity P1. The firing voltage Vf may be almost uniform unless the discharge cells 17 correspond to the dielectric layer 40 having the high permittivity P2. In FIG. 8, distributions are shown with respect to firing voltages Vf_B, Vf_G, and Vf_R in the presence of B, G, and R phosphor layers and a firing voltage Vf_W in a full write condition.

Figure 9:
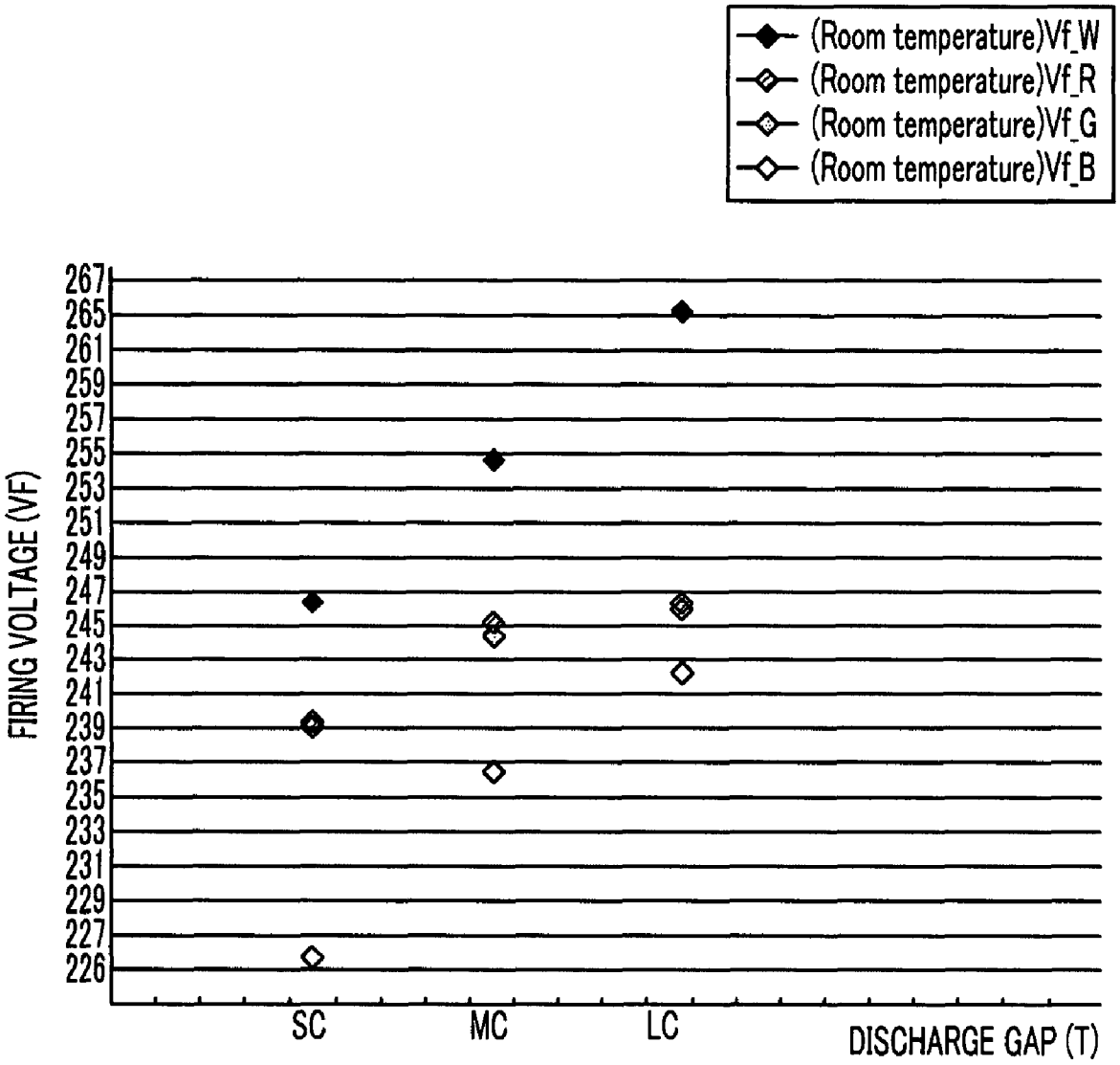
FIG. 9 illustrates a distribution of a firing voltage with respect to a discharge gap and a permittivity of a dielectric layer.

When comparing FIGS. 8 and 9, the firing voltage obtained in the plasma display panel according to an embodiment of the present invention (see FIG. 8) may be distributed with a further improved uniformity than the general firing voltage of FIG. 9.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:

a first substrate;

a second substrate facing the first substrate;

barrier ribs between the first substrate and the second substrate, the barrier ribs defining discharge cells;

address electrodes corresponding to the discharge cells, the address electrodes extending in a first direction;

first electrodes and second electrodes extending in a second direction crossing the first direction, the first electrodes and second electrodes being on any one of the first substrate or the second substrate corresponding to the discharge cells, the first electrodes and the second electrodes being spaced apart to form discharge gaps having distances; and a dielectric layer covering the first electrodes and the second electrodes, the dielectric layer having varying permittivities depending on the respective distances of the discharge gaps.

2. The plasma display panel as claimed in claim 1, wherein the discharge gaps have at least two different distances.

3. The plasma display panel as claimed in claim 1, wherein the dielectric layer has at least two permittivities.

4. The plasma display panel as claimed in claim 1, wherein the discharge gaps comprise:

a first discharge gap having a first distance; and a second discharge gap having a second distance that is less than the first distance, wherein the permittivity of the dielectric layer corresponding to the first discharge gap is higher than the permittivity of the dielectric layer corresponding to the second discharge gap.

5. The plasma display panel as claimed in claim 1, wherein the first electrodes comprise:

bus electrodes extending in the second direction at both edges of the discharge cells; and transparent electrodes protruding from the bus electrodes towards respective centers of the discharge cells in the first direction, wherein the second electrodes comprise:

bus electrodes extending in the second direction at both edges of the discharge cells; and transparent electrodes protruding from the bus electrodes towards respective centers of the discharge cells in the first direction, and wherein the discharge gaps are formed between the transparent electrodes of the first electrodes and the transparent electrodes of the second electrode.

6. The plasma display panel as claimed in claim 1, wherein the first substrate or the second substrate is in a shape of a rectangle, and the distances of the discharge gaps and the permittivities of the dielectric layer become larger from one long side of the rectangle to another long side of the rectangle.

7. The plasma display panel as claimed in claim 1, wherein the first substrate or the second substrate is in a shape of a rectangle, and the distances of the discharge gaps and the permittivities of the dielectric layer become larger from one shorter side of the rectangle to another shorter side of the rectangle.

8. The plasma display panel as claimed in claim 1, wherein the dielectric layer is a sheet having at least two permittivities.

9. The plasma display panel as claimed in claim 1, wherein the discharge gaps comprise:

a first discharge gap having a first distance; and a second discharge gap having a second distance that is less than the first distance, wherein a thickness of the dielectric layer corresponding to the first discharge gap is greater than a thickness of the dielectric layer corresponding to the second discharge gap.

10. The plasma display panel as claimed in claim 1, wherein the discharge gaps comprise:

a first discharge gap having a first distance; and a second discharge gap having a second distance that is less than the first distance, wherein the dielectric layer is covered with a protective layer, and a partial pressure of the protective layer corresponding to the first discharge gap is lower than a partial pressure of the protective layer corresponding to the second discharge gap.

11. The plasma display panel as claimed in claim 10, wherein when the partial pressure is about $1.26\times10^{-7}$ Torr, a firing voltage is about 248 V, and when the partial pressure is about $7.73\times10^{-7}$ Torr, the firing voltage is about 256 V.

12. The plasma display panel as claimed in claim 1, wherein when the discharge gaps have distances of about 70 μm, about 75 μm, about 80 μm, or about 85 μm, the permittivities of the dielectric layer are about 12.3, about 12.8, about 13.3, or about 13.6, respectively.

13. The plasma display panel as claimed in claim 1, wherein when a thickness of the dielectric layer is increased by about 1 μm, a firing voltage is increased by about 3 V.

* * * * *